US005449287A

United States Patent [19]

Simko

[11] Patent Number: 5,449,287

[45] Date of Patent: Sep. 12, 1995

[54] GAS BURNER BLOCK APPARATUS AND METHOD OF MAKING THE SAME

[75] Inventor: Dan Simko, Hammond, Ind.

[73] Assignee: Simko & Sons Industrial Refractories, Inc., East Chicago, Ind.

[21] Appl. No.: 118,504

[22] Filed: Sep. 8, 1993

[51] Int. Cl.[6] ..... F23D 11/00

[52] U.S. Cl. ..... 431/159; 431/182; 431/171; 52/270

[58] Field of Search ..... 431/159, 182, 171, 174, 431/173; 428/99, 120; 52/270, 699

[56] References Cited

U.S. PATENT DOCUMENTS

| | | | |
|---|---|---|---|
| Re. 33,463 | 11/1990 | Sauder et al. | 428/99 |
| 3,033,273 | 5/1962 | Zink, Jr. et al. | 431/174 |
| 3,746,499 | 7/1973 | Guerre et al. | 431/182 |
| 4,580,969 | 4/1986 | Brachet et al. | 431/171 |
| 4,863,314 | 9/1989 | Briemont . | |
| 5,176,876 | 1/1993 | Simko, Jr. . | |

FOREIGN PATENT DOCUMENTS 0010444 3/1980 European Pat. Off. .

OTHER PUBLICATIONS

Tundish cover insert—Item No. S000020500084 ISA Manufacturing, Inc., 1789 Schiller St., Portage, Ind. 46368 Depicted on attached copies of photographs.

*Primary Examiner*—Larry Jones
*Attorney, Agent, or Firm*—Richard G. Kinney

[57] ABSTRACT

A burner entry block constructed of an assembly of a plurality of parallel layers of ceramic fiber insulation bound together with thin layers of refractory mortar sandwiched between adjacent layers, the assembly of such parallel layers forming a generally rectilinear solid assembly, having ceramic fiber layers transversing from front to back of the block and being secured to a mounting plate at their front. Said multi-layered assembly defining a transverse, front-to-back, centrally-located opening, which opening is sized to receive the output of a gas burner positioned at its front. The plate has means for securing the block to a ladle cover or like insulating cover. The block is constructed by the method of successively laying down rectilinear mats into a form made of the back plate, side walls and a bottom wall, securing the ceramic fiber mat to the mounting plate, applying a layer of refractory mortar to the surface of one side of the mat, pressing another layer of mat into the mortar while the mortar is still wet, and repeating the steps with a new mat so as to bind successive mats together by the mortar, and, when the entire assembly is completed, securing a top wall to surround the assembly on all of its sides and cutting out a hole for the burner by slicing through the assembled layers of sandwiched mats from front to back to form the burner output receiving opening therein.

9 Claims, 4 Drawing Sheets

GAS BURNER BLOCK APPARATUS AND METHOD OF MAKING THE SAME

FIELD OF THE INVENTION

The present invention is devoted to a new and improved gas burner block and the method of making the same for use with molten steel ladle covers and similar insulated structures which are to be heated by inserting a gas burner through the cover or like structure.

BACKGROUND OF THE INVENTION

In steelmaking, energy-saving considerations often dictate the use of insulated covers and similar structures over ladles and over molten metal and slag-receiving vessels. See, for example, U.S. Pat. No. 5,176,876, which issued on Jan. 5, 1993 in the name of Joseph S. Simko, Jr. and which is assigned to the same assignee as is the present invention. Because the vessels themselves are often lined with rigid ceramic insulation which would suffer from thermal shock upon the discharge of molten metal or slag into it, the custom has long existed to heat such empty vessels prior to the discharge of molten metal into them. In some ladle covers and like structures, openings have been provided for the insertion of gas burners through the cover so that the cover need not be removed to insert the burner. Because the area immediately around these openings is subject to greater wear and deterioration, replaceable burner blocks have been secured at these openings and these blocks have been made to be relatively easily replaced. These known prior art burner blocks have been made of cast refractory material. Such blocks have proven to be relatively expensive, prone to breakage in the tough environment of an active steel mill, and even when not breaking have had to be replaced at frequent intervals.

There thus exists a need for a burner block which is economical to use, lasts a long time in use, and/or is of rugged construction and not prone to fracture easily.

SUMMARY OF THE INVENTION

To overcome one or more of the drawbacks of the prior art, the present invention provides a gas burner block apparatus which includes a back plate and an insulating assembly secured to one side of the back plate. The insulating assembly comprises a plurality of overlaying ceramic mat sections, each of which is secured to the back plate and extends perpendicularly from one side of the plate and ending at and defining an inner surface. Sandwiched between the mat sections are layers of refractory mortar which cements the adjacent mats to one another to form a unitary insulating assembly. The assembly and the back plate define a transverse opening from the back plate to the inner surface of the assembly, which opening is sized to receive the gas burner, and means are provided for securing the assembly to a ladle cover or like insulated structure.

Another feature of the present invention is the method of forming the assembly, comprising the steps of laying successive mat sections adjacent the back plate and atop one another, securing them to the plate at one side thereof and applying a layer of wet refractory mortar and pressing a new mat therein, so as to form an insulation mass and then cutting out a central core from the opening of the plate to the inner side of the assembly to form a hole or passageway sized to receive the burner.

The invention, together with further advantages and features thereof, may best be understood by reference to the following description, taken in connection with the accompanying drawings, in the several figures of which like reference numerals identify like elements.

DETAILED DESCRIPTION OF ONE PREFERRED EMBODIMENT

Figure 1:
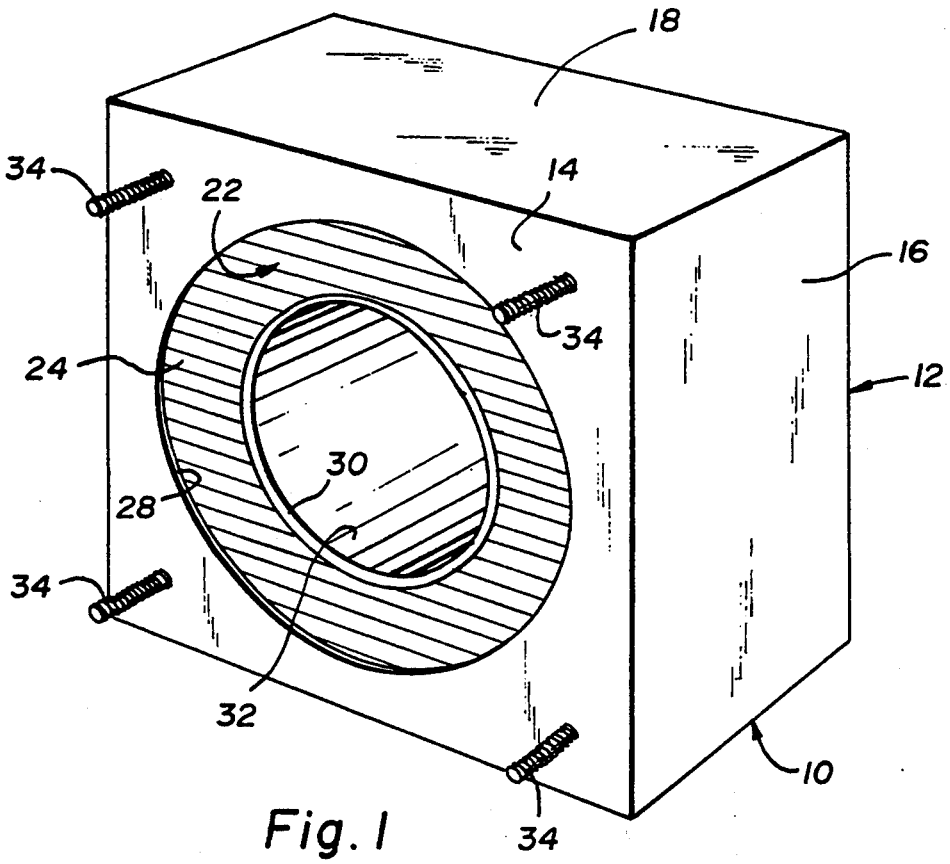
FIG. 1 is a perspective view of the upper side of a block apparatus constructed in accordance with the present invention.

Referring to FIG. 1, there is depicted a gas burner entry block apparatus 10 which is constructed in accordance with the principles of the present invention. The block apparatus 10 has a metal framework 12 consisting of a back plate 14, side walls 16, a top wall 18, and a bottom wall 20 (shown best in FIG. 3). In between the walls 16, 18, and 20 is a mass or assembly 22 of insulation material made up of folded mats 24 cemented together by layers of refractory mortar, as will be explained below. The back plate 14 has a central opening 28 which is sized to be larger than the burner with which the block 10 is to be used. The mass or assembly 22 of insulation has a central opening 30 of a smaller diameter than opening 24. This opening 30 extends from the back to the front side of the assembly 22. A thin layer 32 of refractory mortar is spread on the assembly 22 about the opening 30.

The back plate 14 has four projecting threaded studs 34 at each of its comers for securing the block 10 to a ladle cover or like insulated structure.

Figure 2:
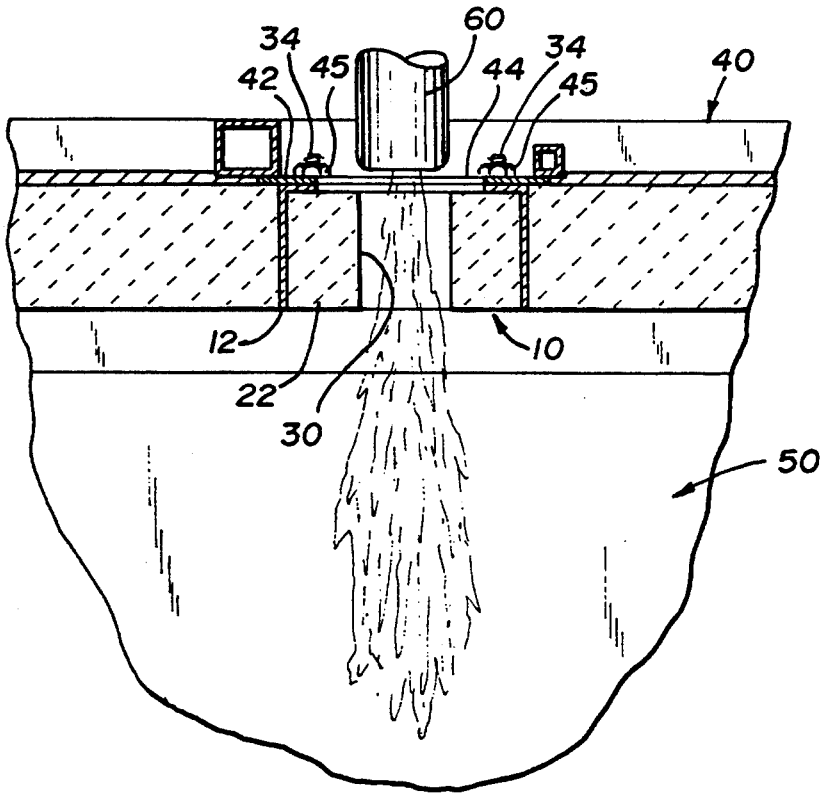
FIG. 2 is a sectional view of the block apparatus of FIG. 1 installed on a ladle cover (partly shown) mounted on a ladle shown with a burner and its flame.

As shown in FIG. 2, the block apparatus 10 is sized to fit in and be secured to a ladle cover 40 which may be of the type shown in the aforementioned U.S. Pat. No. 5,176,876, except for the provision of a burner-receiving apertured plate 42 being slightly larger than the back plate 14 and equipped with a large central opening 44 approximately the size of the opening 28 and also with four small openings sized to receive in a loose fit the threaded studs 34 which are then secured by nuts 45, which are, of course, larger than the stud-receiving openings through the plate 42. The ladle cover 40 is atop a ladle 50 which is to be raised in temperature by means of a gas burner 60 which is positioned at the upper level of the opening 30 of the block apparatus 10 so as to direct its burning gases into the ladle 50.

While the size and detailed construction of the block may vary to meet the demands of the various applications in which the present invention may be used, the particular apparatus 10 depicted and described herein has been built and tested in a Vertical Ladle Preheater. This particular apparatus 10 was approximately 24 inches by 24 inches by 12 inches in overall size (not including the studs 34). The side walls 16, 18, and 20 were constructed of 16 gauge grade A36 steel and the black plate 14 of ⅜ inch thick grade A36 steel and the studs 34 were ¼ inch in diameter and two inches long and positioned at about two inches from each side wall. The opening 28 was 20½ inches in diameter and centrally located on the back plate 14 and the opening 30 was 14 inches in diameter and concentric with the opening 28.

Figure 3:
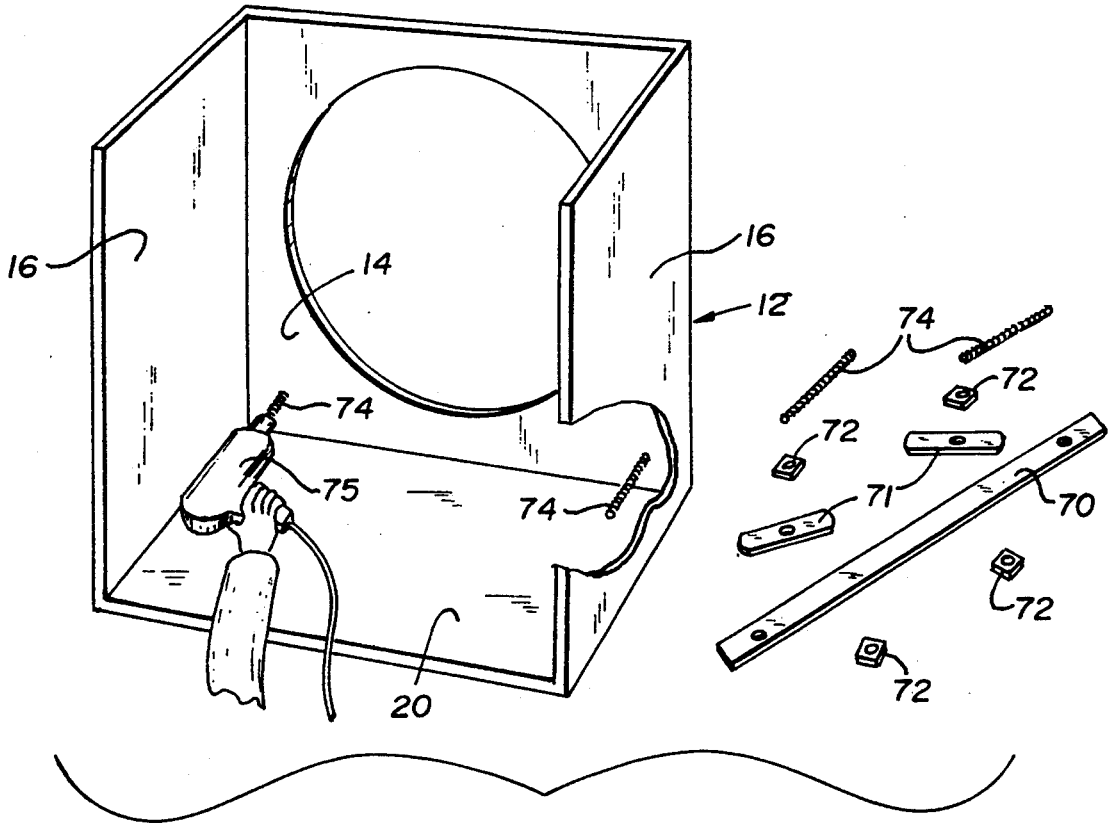
FIG. 3 is a framework (shown partly broken away), which framework is used in making the block apparatus of FIGS. 1 and 2, together with bars, studs and nuts used in the assembling of the block apparatus and a stud welding gun for attaching threaded studs, which gun is shown in use in an initial step of the method of assembling the apparatus of FIGS. 1 and 2.

The construction of the insulation 22 of the block apparatus 10 will be clearer from a discussion of the method of making it. Referring to FIG. 3, there is depicted framework 12 including back plate 14, side walls 16, and bottom wall 20. (Note that the top wall 18 is not yet attached.)

Also shown in FIG. 3 are holed bars 70, 71 of different lengths, and nuts 72 and studs 74. These studs 74 preferably are of a type adapted to be spot welded at one end to a metal surface using a stud welder such as the Nelson Stud Welding system made by the TRW Nelson Stud Welding Division of TRW, Inc., 7900 West Ridge Road, P.O. Box 4019, Elyria, Ohio, 44036–2019.

Also shown in FIG. 3 is one of these studs 74 welded to the inside of the back plate 14 and a stud welding gun 75 in the act of welding a second stud. For the particular prototype discussed above, this first pair of studs 74 is positioned about one inch above the bottom wall 20 and spaced apart transversely so as to receive the openings of bar 70 in a loose fit, with the bar 70 approximately parallel to the bottom wall 20.

Figure 4:
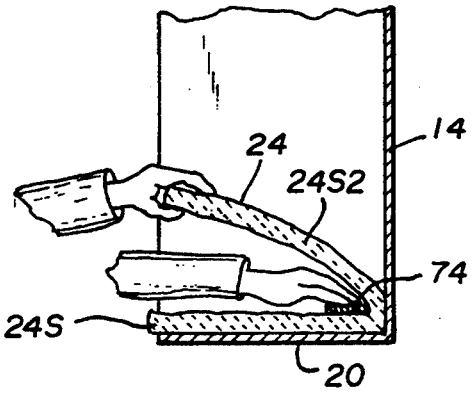
FIGS. 4 through 11 are partial sectional elevational views of the framework of FIG. 3, illustrating successive steps in the assembly of the block apparatus of FIGS. 1 and 2.
Figure 5:
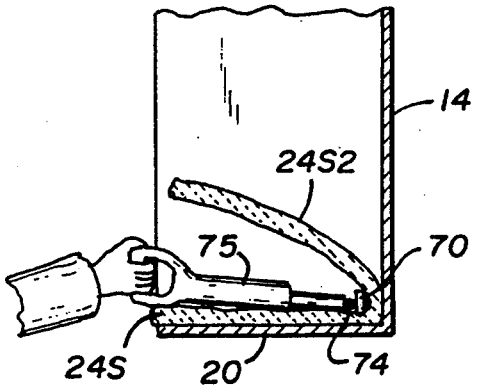
Figure 6:
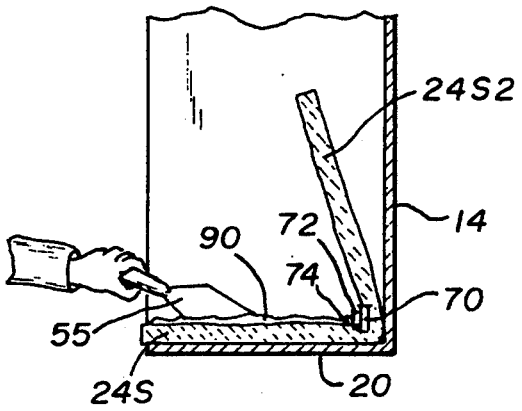
Figure 7:
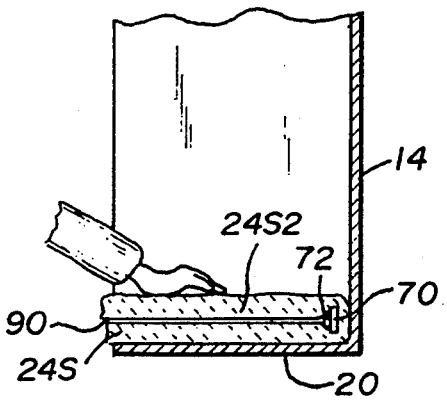
Figure 8:
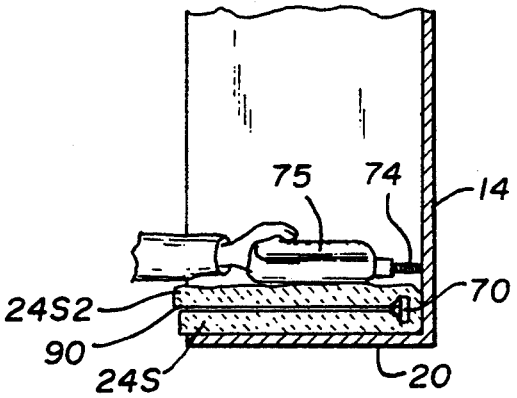
Figure 9:
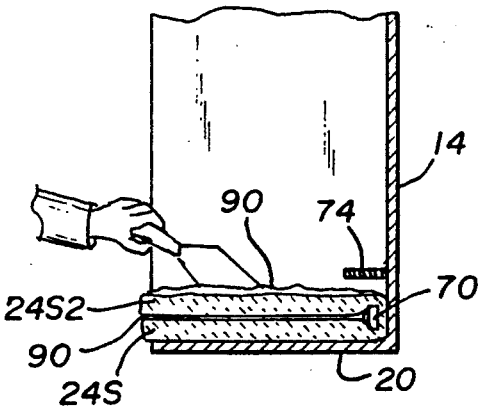
Figure 10:
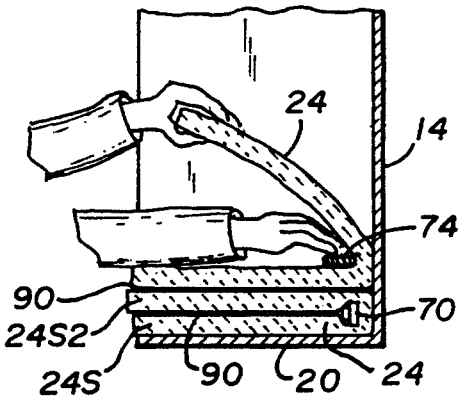
Figure 11:
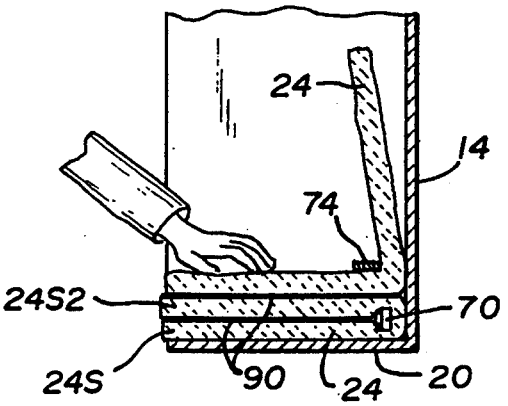

As shown in FIG. 4, the next step after placing two spaced-apart studs on the inside of the plate 14 is to press into place a pre-cut mat 24 sized when folded transversely to form two sections 24S, 24S2, each of which is sized to fit between the walls 16 and overlay the wall 20. By pressing the mat about the studs, the studs 74 push through the mat 24 at the fold. Next, as shown in FIG. 5, the bar 70 is lifted over the studs 74 and the nuts 72 driven on the studs 74 (using any conventional tool such as an air driven nut driver 75) to secure the mat 24 to the plate 14. When that is done, a layer of wet refractory mortar 90 (FIG. 6) is troweled onto or otherwise applied to cover substantially all of the upper surface of the bottom section 24S of the mat 24 (using a trowel 55) and the upper section 24S2 of the mat 24 pressed down (FIG. 7) to bond the two adjacent sections or layers together, with the mortar sandwiched between them. At this point, two more studs 74 are secured (FIG. 8) to the plate 14 and another layer 90 of mortar is applied to the top side of the mat 24 (FIG. 9). Then, a second folded mat 24 is placed and pressed so that the new set of studs 74 pierce it (FIG. 10) and the bottom layer of the new mat 24 is pressed down to secure it to the wet mortar (FIG. 11) and the steps of FIGS. 5, 6, 7, 8 and 9 repeated as to this second mat. The process is repeated with successive mats until the entire volume between the walls 16 is filled. During this process, pairs of bars such as the bars 71 are used with one hole each on either side of the opening 28. The bars 71 are sized so that they do not vertically extend into the space that will become opening 30 for reasons which will shortly be clear.

Figure 12:
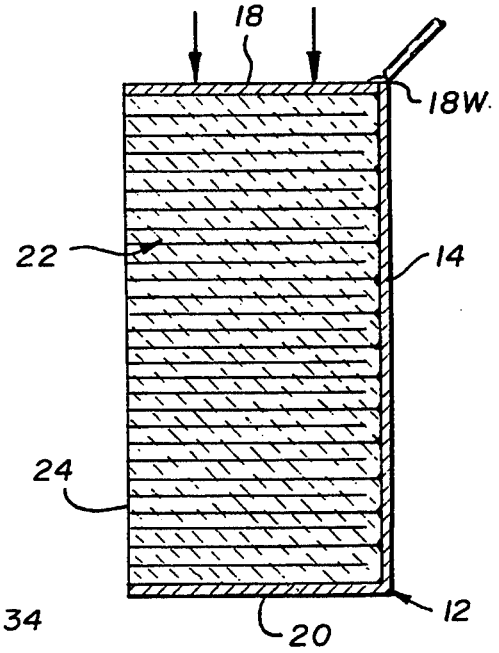
FIG. 12 is a further step, attaching a top wall, in the method of assembly being performed after the steps of FIGS. 3 to 11 have been successively repeated to secure a unitary mass of insulating material to fill the framework of FIG. 3.

When the entire volume between the walls 16 is filled (and the assembly 22 is slightly above tile top of the walls 16) with a succession of layers of ceramic batting mats 24 with layers of mortar in between, the top wall 18 is pressed down to further compress the insulation 22 and is welded (as at 28W) in place (FIG. 12).

Figure 13:
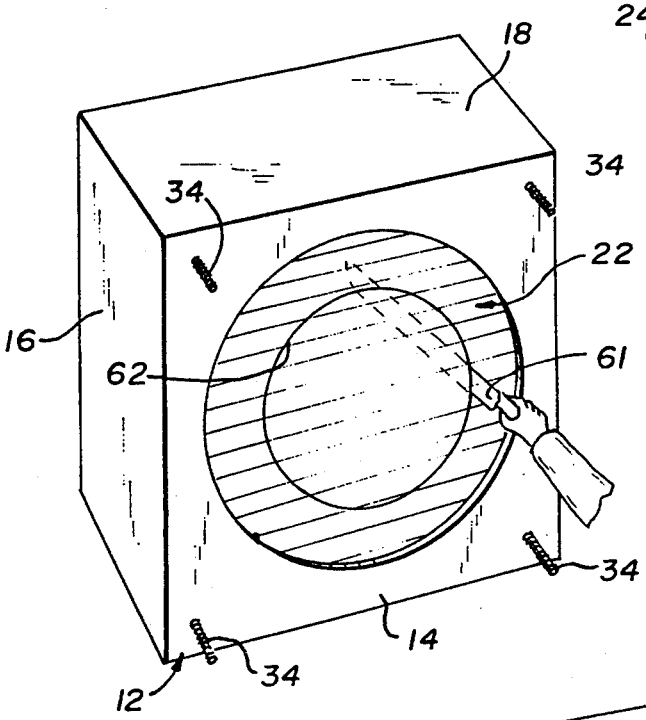
FIG. 13 is a perspective view of the assembly after the step of FIG. 12 showing the method of forming a burner output-receiving opening therethrough.
Figure 14:
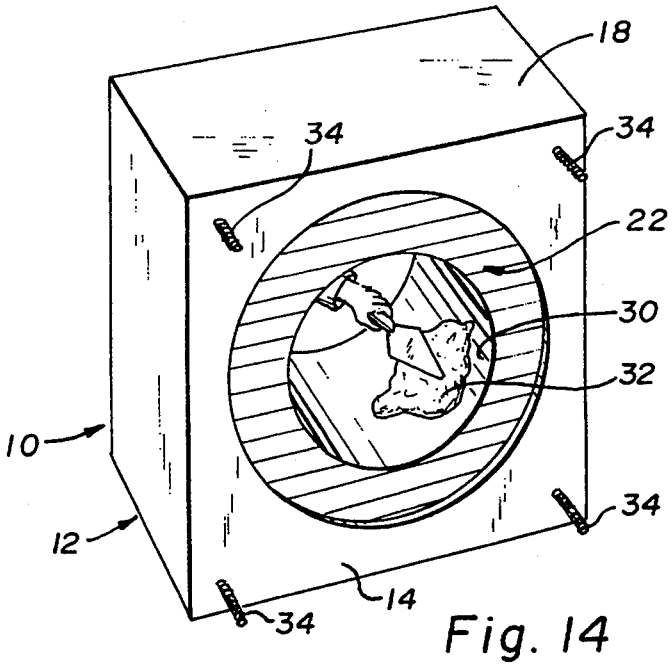
FIG. 14 is a perspective view similar to that of FIG. 13, illustrating the final step in the assembling of the block apparatus of FIGS. 1 and 2.

The assembly so far is shown in FIG. 13 and the next to last major step is being performed in that figure. This is the marking of the outline 62 of the opening 30 and the cutting out, using a long knife 61, of a cylindrical plug from the insulation 22 to form that opening. After this step, the apparatus 10 is finished by applying a thin layer 32 of refractory mortar to the inside surface of the opening 30, as shown in FIG. 14.

Again, while the invention may be practiced in a large number of ways, for specificity of disclosure, the particular prototype unit referred to above which has been constructed and tested, employed a mat of one inch thickness of ceramic fiber (such as Cer-Wool® HTZ, No. 174830, available from Premier Refractories of 901 E. 8th Avenue, King of Prussia, Penn. 19406) with an overall unfolded size of about 24 inches by 24 inches. The bars 70, 71 were made of fiat steel ¼ inch thick and ½ inch wide and of varying lengths to fit as explained above. The threaded studs 74 were ¼ inch wide and about two inches in length. The studs on each side of the back plate are placed at a vertical displacement of about one inch from each other. (These studs may be affixed at any convenient stage in the construction of the block 10.) Thus, approximately twenty-four (24) mats are employed in making the assembly 22 of this specific example. The mortar used was Super 3000 brand made by Premier, although other high-temperature mortars could, it is believed, be easily substituted for this particular mortar. It is, of course, important to press the layers into the mortar while it is still wet and it is preferred that the step of FIG. 13 be performed while the mortar has not yet finally set. The mortar is preferably allowed to fully set before the assembled block 10 is installed and used.

While one particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention.

I claim:

1. A gas burner block apparatus for use with an insulating covering structure for allowing a gas burner of predetermined cross-sectional size to be mounted above its opening and to receive burning gases therefrom, said apparatus comprising, in combination:

a back plate having an opening sized to easily receive the gas burner;

a plurality of overlapping adjacent ceramic fiber mat sections secured to one side of said back plate and positioned generally perpendicularly to said plate and generally parallel to one another and overlapping one another, said mats having layers of refractory mortar sandwiched between them so as to bind adjacent layers of mats into a unitary assembly of insulating material shaped to conform to the periphery of the back plate and extending to an inner surface formed by such material, said unitary assembly of insulating material also defining a transverse opening between the back plate opening to the inner surface, which opening is sized and shaped to receive the gas burner's output gases; and means for attaching the apparatus to the covering structure.

2. The apparatus of claim 1, wherein said mat sections are secured to the back plate by having a mat folded lengthwise to form two sections and having a rod at the inside fold secured to said plate.

3. The apparatus of claim 2, wherein said rods are secured to the plate by means of a threaded stud welded at one end to the plate, which stud passes through a hole defined in said rod and has a nut larger than the hole in the rod threaded and tightened against the rod.

4. The method of making a gas burner block apparatus using a plurality of ceramic fiber mat sections and wet refractory mortar, said process comprising the steps of superimposing successive ceramic fiber mat sections one on another while applying a thin layer of wet refractory mortar on one side of the section and pressing the next adjacent mat section into the mortar layer, so that a multi-layer assembly is formed united into an insulating mass by the mortar, and cutting out a plug from the assembly mass so as to form an opening through the mass, which opening is sized to receive the hot gases from the gas burner.

5. The method of claim 4 which also employs a back plate having an opening therein and means for attaching the mat sections to said back plate, which method includes the steps of attaching mat sections to the plate while forming said multi-layered assembly and prior to the cutting out of the plug.

6. The method of claim 5, wherein adjacent pairs of said mat sections are formed from a unitary mat and folded so as to overlay one another and said means for attaching includes a bar at the interior of the fold which is attached to each plate as the mat is assembled into the assembly.

7. The gas burner block apparatus of claim 1, wherein the surface of said unitary assembly transverse opening is lined with a thin layer of refractory mortar between said back plate opening and said inner surface.

8. The gas burner block apparatus of claim 6, wherein said back plate periphery is square, the block is rectilinear in overall shape, and said transverse opening is circular in cross section.

9. The method of claim 4, wherein after cutting out of the plug a thin layer of wet refractory mortar is applied to the interior surface of the mass forming the opening through the mass.

* * * * *